US009571946B2

(12) United States Patent
Hansen et al.

(10) Patent No.: US 9,571,946 B2
(45) Date of Patent: Feb. 14, 2017

(54) HEARING DEVICE WITH CLOSURE MECHANISM

(71) Applicant: GN ReSound A/S, Ballerup (DK)

(72) Inventors: Finn Hansen, Smorum (DK); Henrik Nielsen, Roskilde (DK)

(73) Assignee: GN HEARING A/S, Ballerup (DK)

( * ) Notice: Subject to any disclaimer, the term of this patent is extended or adjusted under 35 U.S.C. 154(b) by 124 days.

(21) Appl. No.: 14/478,333

(22) Filed: Sep. 5, 2014

(65) Prior Publication Data

US 2016/0066108 A1 Mar. 3, 2016

(30) Foreign Application Priority Data

Sep. 2, 2014 (DK) ..... 2014 70533
Sep. 2, 2014 (EP) ..... 14183206

(51) Int. Cl.
*H04R 25/00* (2006.01)

(52) U.S. Cl.
CPC ..... *H04R 25/602* (2013.01); *H04R 25/65* (2013.01)

(58) Field of Classification Search
CPC ..... H04R 25/602; H04R 25/65; H04R 25/658
See application file for complete search history.

(56) References Cited

U.S. PATENT DOCUMENTS 3,701,862 A 10/1972 Vignini
3,828,142 A 8/1974 Buttner
4,272,591 A 6/1981 Brander
7,106,872 B2 * 9/2006 Masters ..... H04R 25/65 381/322
2004/0062409 A1 * 4/2004 Batting ..... H04R 25/556 381/323

(Continued)

FOREIGN PATENT DOCUMENTS

DE 196 01 231 A1 7/1997
DE 10 2010 041 263 A1 3/2012

(Continued)

OTHER PUBLICATIONS

First Technical Examination and Search Report dated Mar. 19, 2015 for corresponding Danish Patent Application No. PA 2014 70533, 6 pages.

(Continued)

*Primary Examiner* — Matthew Eason
*Assistant Examiner* — Taunya McCarty
(74) *Attorney, Agent, or Firm* — Vista IP Law Group, LLP

(57) ABSTRACT

A hearing device includes: a housing with a frame; a battery door attached to the housing and configured to pivot in relation to the housing about a pivot axis, the battery door having a side wall with a first wall surface at least partly defining a battery compartment with a battery axis, the first wall surface comprising contact points for supporting a battery, the contact points having equal distances to the battery axis, wherein a first vector extends from the battery axis and perpendicularly crosses the pivot axis in a first direction to the pivot axis; and a closure mechanism comprising a protruding member with a distal end, and an engagement member having a first arm with a first distal end, wherein the protruding member is configured to engage with the engagement member when the battery door is in a closed position.

16 Claims, 9 Drawing Sheets

(56) References Cited

U.S. PATENT DOCUMENTS

| | | | | |
|---|---|---|---|---|
| 2007/0081686 | A1* | 4/2007 | Sluppke | H04R 25/608 381/330 |
| 2007/0293081 | A1* | 12/2007 | Heerlein | H04R 25/602 439/500 |
| 2009/0252359 | A1* | 10/2009 | Ho | H04R 25/602 381/323 |
| 2010/0226519 | A1* | 9/2010 | Spragge | H04R 25/602 381/323 |
| 2010/0290655 | A1 | 11/2010 | Takeda et al. | |
| 2011/0026747 | A1* | 2/2011 | Ochsenbein | H04R 25/602 381/323 |
| 2012/0093349 | A1* | 4/2012 | Chua | H04R 25/602 381/323 |
| 2013/0236041 | A1 | 9/2013 | Flaig | |
| 2014/0177893 | A1 | 6/2014 | Lu et al. | |

FOREIGN PATENT DOCUMENTS

| | | | |
|---|---|---|---|
| EP | 2 262 284 | A1 | 12/2010 |
| EP | 2 713 630 | A1 | 4/2014 |
| EP | 2 779 697 | A1 | 9/2014 |
| WO | WO 2007/001234 | A1 | 1/2007 |

OTHER PUBLICATIONS

Extended European Search Report dated Apr. 9, 2015 for corresponding European Application No. 14183206.3, 5 pages.

* cited by examiner

HEARING DEVICE WITH CLOSURE MECHANISM

RELATED APPLICATION DATA

This application claims priority to and the benefit of Danish Patent Application No. PA 2014 70533, filed Sep. 2, 2014, pending, and European Patent Application No. 14183206.3, filed Sep. 2, 2014, pending. The entire disclosures of both of the above applications are expressly incorporated by reference herein.

FIELD

The present disclosure relates to a hearing device with a closure mechanism, and in particular to a hearing device with a battery door for accommodating and/or supporting a battery in the hearing device.

BACKGROUND

A focus in the hearing aid industry is to make hearing aids smaller and more discrete for the benefit of the user and thus a design which can decrease the size of the hearing aid is of importance. Further, it is of great interest from a cost perspective that designs are easy and cheap to manufacture. Generally a button battery is used in a hearing device and traditionally a battery door of a hearing aid has been fitted with a locking mechanism leading to bulky hearing devices, a complex manufacturing process and/or high failure rate of the locking mechanism.

Further, hearing device parts must be robust and resistant to wear. Further, precise fitting of moving parts is desired for improving the user experience.

Typically a closure mechanism is arranged as far from the pivot axis as possible to reduce the mechanical stress on parts of the closure mechanism.

SUMMARY

There is a need for an improved closure mechanism suitable for a hearing device.

Disclosed is a hearing device comprising: a housing with a frame; a battery door attached to the housing and configured to pivot in relation to the housing about a pivot axis, the battery door having a side wall with a first wall surface at least partly defining a battery compartment with a battery axis, the first wall surface comprising contact points for supporting a battery, the contact points having equal distances to the battery axis, and wherein a first vector extends from the battery axis and perpendicularly crosses the pivot axis in a first direction from the battery axis to the pivot axis; and a closure mechanism comprising a protruding member with a distal end, and an engagement member having a first arm with a first distal end, wherein the protruding member is configured to engage with the engagement member when the battery door is in a closed position. The closure mechanism may be arranged in an angular space spanned by the first vector and a second vector extending from the battery axis in a second direction and being perpendicular to the pivot axis. The angle between the first vector and the second vector may be less than 150°, such as less than 130°, such as less than 120°.

The disclosed hearing device provides a durable and sustainable closure mechanism for a battery door of a hearing device. The engagement member and/or protruding member may be separable from the frame and/or battery door. Closure members, such as the protruding member and/or the engagement member, being independent from the frame provides an increased design freedom. Hence, the engagement member and/or protruding member may be manufactured in a material different from the frame and/or battery door. It is desired, within the technical field, to manufacture different parts by materials having mechanical properties matching the mechanical requirements of the specific part. For example, the engagement member is subject to mechanical wear and requires flexibility different from requirements of the frame and/or battery door. Furthermore mechanical requirements of the engagement member and protruding member may be different in several respects such as wear and/or flexibility.

The disclosed hearing device limits the tolerance chain between the closure mechanism and the frame and battery door. Therefore, as a further advantage, the disclosed hearing device facilitates limited requirements for tolerances of parts, leading to simplified manufacture.

As an even further advantage, the closure mechanism may provide reduced wear on the battery door hinge arrangement. The primary directional component of the displacement of the first arm and/or a second arm may be parallel to the pivot axis, thereby reducing wear on the battery door hinge arrangement and closure mechanism.

The positioning of the closure mechanism provides increased design flexibility and enables a small hearing device.

A hearing device includes: a housing with a frame; a battery door attached to the housing and configured to pivot in relation to the housing about a pivot axis, the battery door having a side wall with a first wall surface at least partly defining a battery compartment with a battery axis, the first wall surface comprising contact points for supporting a battery, the contact points having equal distances to the battery axis, wherein a first vector extends from the battery axis and perpendicularly crosses the pivot axis in a first direction from the battery axis to the pivot axis; and a closure mechanism comprising a protruding member with a distal end, and an engagement member having a first arm with a first distal end, wherein the protruding member is configured to engage with the engagement member when the battery door is in a closed position.

Optionally, the closure mechanism is arranged in a space defined between the first vector and a second vector extending from the battery axis in a second direction, and being perpendicular to the pivot axis, wherein an angle between the first vector and the second vector is less than 150°.

Optionally, the protruding member extends from the side wall.

Optionally, the protruding member comprises a primary recess, and wherein the primary recess is configured to engage with the engagement member when the battery door is in the closed position.

Optionally, the protruding member comprises a secondary recess, wherein the secondary recess is configured to engage with the engagement member when the battery door is in a semi-closed position.

Optionally, the primary recess is configured to support the first arm along a primary section of the primary recess when the battery door is in the closed position.

Optionally, the protruding member comprises a primary surface between the distal end of the protruding member and the primary recess, the primary surface having a primary normal, and wherein an angle between the primary normal and a principal direction along the primary recess is anywhere from 75° to 88°.

Optionally, the sidewall of the battery door comprises a dock for attaching the protruding member or the engagement member to the battery door.

Optionally, the first distal end of the first arm is displaceable in a displacement direction when the battery door is moved from an open position to the closed position, wherein the displacement direction has a primary directional component parallel to the pivot axis.

Optionally, the displacement direction has a secondary directional component perpendicular to the primary directional component, the secondary directional component being smaller than the primary directional component.

Optionally, the engagement member has a second arm with a second distal end.

Optionally, the engagement member is made of metal.

Optionally, the frame comprises a compartment for receiving the engagement member and connecting the engagement member to the frame.

Optionally, the engagement member is movable within the compartment in at least one direction in a plane parallel to the pivot axis.

Optionally, the first distal end of the first arm is displaceable in a first displacement direction when the battery door is moved from an open position to the closed position, wherein the first displacement direction has a first primary directional component parallel to the pivot axis; wherein the hearing device further comprises a second arm with a second distal end that is displaceable in a second displacement direction when the battery door is moved from the closed position to a semi-closed position, the second displacement direction having a second primary directional component; and wherein the at least one direction includes the first primary directional component and the second primary directional component.

Other and further aspects and features will be evident from reading the following detailed description of the embodiments.

BRIEF DESCRIPTION OF THE DRAWINGS

In the following, exemplary hearing devices and parts thereof are explained in more detail with reference to the drawings, wherein FIG. 1 schematically illustrates an exemplary hearing device with a battery door, FIG. 2 schematically and partially illustrates an exemplary hearing device with a battery door in a closed position, FIG. 3 schematically and partially illustrates an exemplary hearing device with a battery door in a semi-closed position, FIG. 4 schematically illustrates an exemplary battery door.

DETAILED DESCRIPTION

Figure 1:
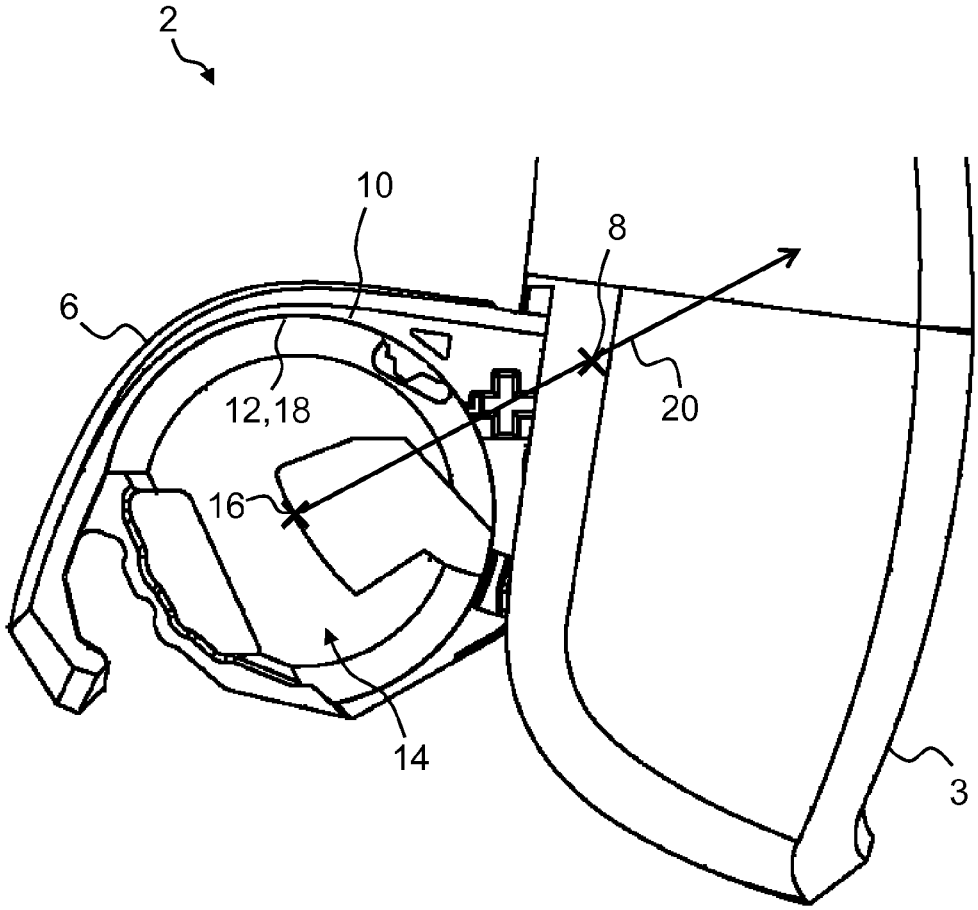

Various embodiments are described hereinafter with reference to the figures. It should be noted that elements of similar structures or functions are represented by like reference numerals throughout the figures. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

The housing may comprise one or more shell parts. For example, the frame may carry one or more shell parts. The frame may form a part of the housing.

The battery door may be in an open position. The open position may provide the user access to the battery compartment e.g. for displacement and/or insertion of the battery.

The battery door may be in the closed position. The closed position may provide electrical connection between the battery and circuitry of the hearing device.

The battery door may be in a semi-closed position. The semi-closed position may provide a position wherein the battery door is retained in position relative to the frame, and wherein the battery is electrically disconnected, e.g. the semi-closed position may provide an OFF position.

The battery door may be moved between the open position and the closed position, or between the open position and the semi-closed position, or between the semi-closed position and the closed position, by pivoting in relation to the frame about the pivot axis.

A closing direction of the battery door may be in the angular space spanned by the first vector and the second vector. The closing direction may be the tangential direction to the pivoting of the battery door when the battery door is moved from the open position towards the closed position and/or semi-closed position. An opening direction of the battery door may be opposite the closing direction.

The battery door may be configured to receive a battery in a direction parallel to the pivot axis, i.e. a user inserts or removes the battery by movement of the battery parallel to the pivot axis The closure mechanism comprises the engagement member having a first arm. The engagement member may be I-shaped. The engagement member may be U-shaped. The engagement member may have a second arm with a second distal end. Providing the engagement member with the first arm and the second arm arranged oppositely, such as a U-shape, or H-shape reduces internal stress of the engagement member and/or distributes the internal stress more appropriately. The engagement member may have a plurality of arms, including the first arm and the second arm.

The first arm may be flexible such that the first distal end displaces in a first displacement direction when the battery door is moved from the open position to the closed position.

The first arm may be flexible such that the first distal end displaces in a first displacement direction when the battery door is moved from the open position to the semi-closed position.

The first arm may be flexible such that the first distal end displaces in a first displacement direction when the battery door is moved from the semi-closed position to the closed position.

The first arm may be flexible such that the first distal end displaces in a first displacement direction when the battery door is moved from the closed position to the open position.

The first arm may be flexible such that the first distal end displaces in a first displacement direction when the battery door is moved from the semi-closed position to the open position.

The first arm may be flexible such that the first distal end displaces in a first displacement direction when the battery door is moved from the closed position to the semi-closed position.

The first displacement direction may have a first primary directional component parallel to and/or within ±10° of the pivot axis. The first displacement direction may have a first secondary directional component perpendicular to the first primary directional component. The first secondary directional component may be smaller than the first primary directional component, such as less than 50% of the first primary directional component.

The second arm may be flexible such that the second distal end displaces in a second displacement direction when the battery door is moved from the open position to the closed position.

The second arm may be flexible such that the second distal end displaces in a second displacement direction when the battery door is moved from the open position to the semi-closed position.

The second arm may be flexible such that the second distal end displaces in a second displacement direction when the battery door is moved from the semi-closed position to the closed position.

The second arm may be flexible such that the second distal end displaces in a second displacement direction when the battery door is moved from the closed position to the open position.

The second arm may be flexible such that the second distal end displaces in a second displacement direction when the battery door is moved from the semi-closed position to the open position.

The second arm may be flexible such that the second distal end displaces in a second displacement direction when the battery door is moved from the closed position to the semi-closed position.

The second displacement direction may have a second primary directional component parallel to and/or within ±10° of the pivot axis. The second displacement direction may have a second secondary directional component perpendicular to the second primary directional component. The second secondary directional component may be smaller than the second primary directional component, such as less than 50% of the second primary directional component.

The first primary directional component and/or the second primary directional component may be larger than 0.05 mm, such as larger than 0.2 mm, such as larger than 0.5 mm.

The ratio between the first primary and first secondary directional component and/or the ratio between the second primary and the second secondary directional component may be more than 2:1, such as more than 5:1, such as more than 10:1, wherein the first secondary directional component is smaller than the first primary directional component and/or the second secondary directional component is smaller than the second primary directional component.

The first primary directional component and the second primary directional component may be opposite, i.e. point in opposite directions. Providing the engagement member with the first arm and a second arm arranged such that the first primary directional component and the second primary directional component are opposite, may provide an engagement member with reduced requirement to fastening to the frame and/or battery door, since a force generating displacement of the first distal end in the first direction is balanced, or at least partly balanced, by another force generating displacement of the second distal end in the second direction.

Balancing forces, reducing internal stress and/or distributing internal stress reduce requirements to the material and manufacturing processes, and reduce the risk of failing parts. Furthermore, an increased design freedom and reduction in size may be achieved.

The closure mechanism comprises the protruding member. The protruding member may extend from the side wall of the battery door. The protruding member may extend perpendicular to the pivot axis. Alternatively, the protruding member may extend from the frame. The protruding member and the battery door may be cast together as a single piece, or the protruding member and the frame may be cast together as a single piece. Alternatively, the protruding member may be cast separately. The protruding member may subsequently be attached to the battery door or the frame.

The sidewall of the battery door may comprise a dock for attaching the protruding member or the engagement member to the battery door. Provision of a dock in the sidewall facilitates that the protruding member, the engagement member, and/or the battery door may be manufactured separately and assembled subsequently. Manufacturing the protruding member, the engagement member, and/or the battery door seperately provides a possibility of providing the protruding member, the engagement member and/or the battery door in different materials. The dock may comprise locking element(s). The locking element(s) may act to retain the protruding member when the protruding member is inserted into the dock, e.g. providing a press-fit-lock, a click-lock and/or a twist-lock.

The protruding member may comprise a first primary recess. The first primary recess may be configured to engage with the engagement member when the battery door is in the closed position. The first primary recess may be configured to engage with the first arm of the engagement member when the battery door is in the closed position.

The protruding member may comprise a second primary recess. The second primary recess may be configured to engage with the engagement member when the battery door is in the closed position. The second primary recess may be configured to engage with the second arm of the engagement member when the battery door is in the closed position.

The first primary recess and the second primary recess may be positioned on opposite sides of the protruding member. For example, the first primary recess and the second primary recess may be positioned such that the first arm engages the first primary recess concurrently, or substantially concurrently, with the second arm engaging the second primary recess.

The protruding member may comprise a first secondary recess. The first secondary recess may be configured to engage with the engagement member when the battery door is in a semi-closed position. The first secondary recess may be configured to engage with the first arm of the engagement member when the battery door is in the semi-closed position.

The protruding member may comprise a second secondary recess. The second secondary recess may be configured to engage with the engagement member when the battery door is in a semi-closed position. The second secondary recess may be configured to engage with the second arm of the engagement member when the battery door is in the semi-closed position.

The first secondary recess and the second secondary recess may be positioned on opposite sides of the protruding member. For example, the first secondary recess and the second secondary recess may be positioned such that the first arm engages the first secondary recess concurrently, or substantially concurrently, with the second arm engaging the second secondary recess.

The first primary recess may be configured to support the first arm along a first primary section of the first primary recess when the battery door is in the closed position. The second primary recess may be configured to support the second arm along a second primary section of the second primary recess when the battery door is in the closed position. The first secondary recess may be configured to support the first arm along a first secondary section of the first secondary recess when the battery door is in the semi-closed position. The second secondary recess may be configured to support the second arm along a second secondary section of the second secondary recess when the battery door is in the semi-closed position.

Supporting the first arm and/or the second arm along a section, such as the first primary section, the second primary section, the first secondary section, and/or the second secondary section, provides distribution of pressure between the engagement member and the protruding member in the closed and/or semi-closed position, thus, reducing wear on the engagement member and/or the protruding member.

The protruding member may comprise a first primary surface between the distal end and the first primary recess. The first primary surface may be between the first secondary recess and the first primary recess. The first primary surface may have a first primary normal. The angle between the first primary normal and the principal direction along the first primary recess may be less than 90°, such as in the range from 75° to 88°. The first primary surface may be configured to support the first arm along a section of the first arm when the battery door is in a position between the open position and the closed position, such as in between the semi-closed position and the closed position.

The protruding member may comprise a first secondary surface between the distal end and the first secondary recess. The first secondary surface may have a first secondary normal. The angle between the first secondary normal and the principal direction along the first primary recess and/or the first secondary recess may be less than 90°, such as in the range from 75° to 88°. The first secondary surface may be configured to support the first arm along a section of the first arm, when the battery door is in a position between the open position and the closed position, such as in between the semi-closed position and the closed position.

The protruding member may comprise a second primary surface between the distal end and the second primary recess. The second primary surface may be between the second secondary recess and the second primary recess. The second primary surface may have a second primary normal. The angle between the second primary normal and the principal direction along the second primary recess may be less than 90°, such as in the range from 75° to 88°. The second primary surface may be configured to support the second arm along a section of the second arm when the battery door is in a position between the open position and the closed position, such as in between the semi-closed position and the closed position.

The protruding member may comprise a second secondary surface between the distal end and the second secondary recess. The second secondary surface may have a second secondary normal. The angle between the second secondary normal and the principal direction along the second primary recess and/or the second secondary recess may be less than 90°, such as in the range from 75° to 88°. The second secondary surface may be configured to support the second arm along a section of the second arm, when the battery door is in a position between the open position and the closed position, such as in between the semi-closed position and the closed position.

Providing the angle, such as the angle between the first primary normal and the principal direction along the first primary recess, the angle between the first secondary normal and the principal direction along the first primary recess and/or the first secondary recess, the angle between the second primary normal and the principal direction along the second primary recess, the angle between the second secondary normal and the principal direction along the second primary recess and/or the second secondary recess, of less than 90° facilitates support of the first arm and/or second arm along a section when the battery door is in a position between the open position and the closed position, such as in between the semi-closed position and the closed position and/or in between the open position and the semi-closed position.

When the battery door is moved from the open position to the closed position and/or from the open position to the semi-closed position and/or from the semi-closed position to the closed position and/or from the closed position to the open position and/or from the semi-closed position to the open position and/or from the closed position to the semi-closed position, the first distal end of the first arm displaces in the first displacement direction and/or the second distal end of the second arm displaces in the second displacement direction. The displacement of the first distal end and/or second distal end may provide a different inclination of the first arm and/or second arm relative to the protruding member. Thus, to facilitate support of the first arm and/or second arm when the battery door is in a position between the closed position and the open position, such as between the closed position and the semi-closed position and/or between the open position and the semi-closed position, the angle, such as the angle between the first primary normal and the principal direction along the first primary recess, the angle between the first secondary normal and the principal direction along the first primary recess and/or the first secondary recess, the angle between the second primary normal and the principal direction along the second primary recess, and/or the angle between the second secondary normal and the principal direction along the second primary recess and/or the second secondary recess, may be less than 90°.

The protruding member may be cast in the same material as the battery door. The protruding member and the battery door may be cast as one piece. Alternatively, the protruding member may be cast in a different material as the battery door. The protruding member may be cast in a plastic material, such as POM (Polyoxymethylene) and/or ABS (acrylonitrile butadiene styrene). For example, POM may be beneficial due to its flexible ability and surface friction. The protruding member may be subject to friction, such as friction by the engagement member. The material for the protruding member may be selected such as to increase durability of the protruding member, e.g. a plastic material, such as POM.

The engagement member may be subject to frequent bending. The engagement member may be made of metal. Providing the engagement member in metal may provide desirable flexibility and strength, thereby reducing the risk of failure, and furthermore facilitate manufacturing an engagement member with a desirable rigidity to provide durable closure mechanism requiring a consistent force to move the battery between the open position and the closed position.

The frame may comprise a compartment for receiving the engagement member and connecting the engagement member to the frame. Providing a compartment for receiving the engagement member may facilitate that the engagement member may be manufactured in a different material than the frame. The engagement member may be movable within the compartment. The engagement member may be movable within the compartment in at least one direction in a plane parallel to the pivot axis. The at least one direction may include the first primary directional component and/or the second primary directional component. The engagement member being movable within the compartment, may provide the engagement member to align itself to the protruding member, when the battery door is in a closed position, semi-closed position, and/or a position in between the open position and the closed position, such as in between the semi-closed position and the closed position. The engagement member may be movable within the compartment and restricted from movement in a direction parallel to the protruding member.

The engagement member may be received in the compartment by inserting the engagement member into the dock in a direction parallel, or substantially parallel, to a plane defined by the engagement member, such as a plane parallel to the first arm and/or the second arm. After insertion of the engagement member in the compartment, the compartment may be sealed to prevent subsequent removal of the engagement member from the compartment. For example, the compartment may be sealed by shell parts of the hearing device attached to the frame.

The pivot axis may in an exemplary hearing device move during opening and/or closing of the battery door relative to the housing. Thus, the pivot axis may have a first position when the battery door is in the closed position and a second position when the battery door is in the open position.

FIG. 1 schematically illustrates an exemplary hearing device 2 with a battery door 6. The hearing device 2 comprises a housing 3 with a frame; a battery door 6, and a closure mechanism 22 (not shown in FIG. 1). The battery door 6 is attached to the housing 3 and configured to pivot in relation to the housing 3 about a pivot axis 8. The battery door 6 has a side wall 10 with a first wall surface 12 at least partly defining a battery compartment 14 with a battery axis 16. The first wall surface 12 comprises contact points 18 for supporting a battery (not shown). In the depicted example, the contact points 18 outline the first wall surface 12. In another exemplary battery door (not shown) the contact points 18 may extend a distance from the first wall surface 12. The contact points 18 have equal distances to the battery axis 16. Thus, the contact points 18 are distributed on an imaginary circle with a centre defined by the battery axis 16. A first vector 20 extends from the battery axis 16 and perpendicularly crosses the pivot axis 8 in a first direction from the battery axis 16 to the pivot axis 8. The housing 3 of the hearing device 2 may comprise one or more shell parts. In the depicted example, the first vector 20 extends perpendicular to the battery axis 16. However, in other exemplary hearing devices the first vector 20 may extend non-perpendicularly to the battery axis 16.

Figure 2:
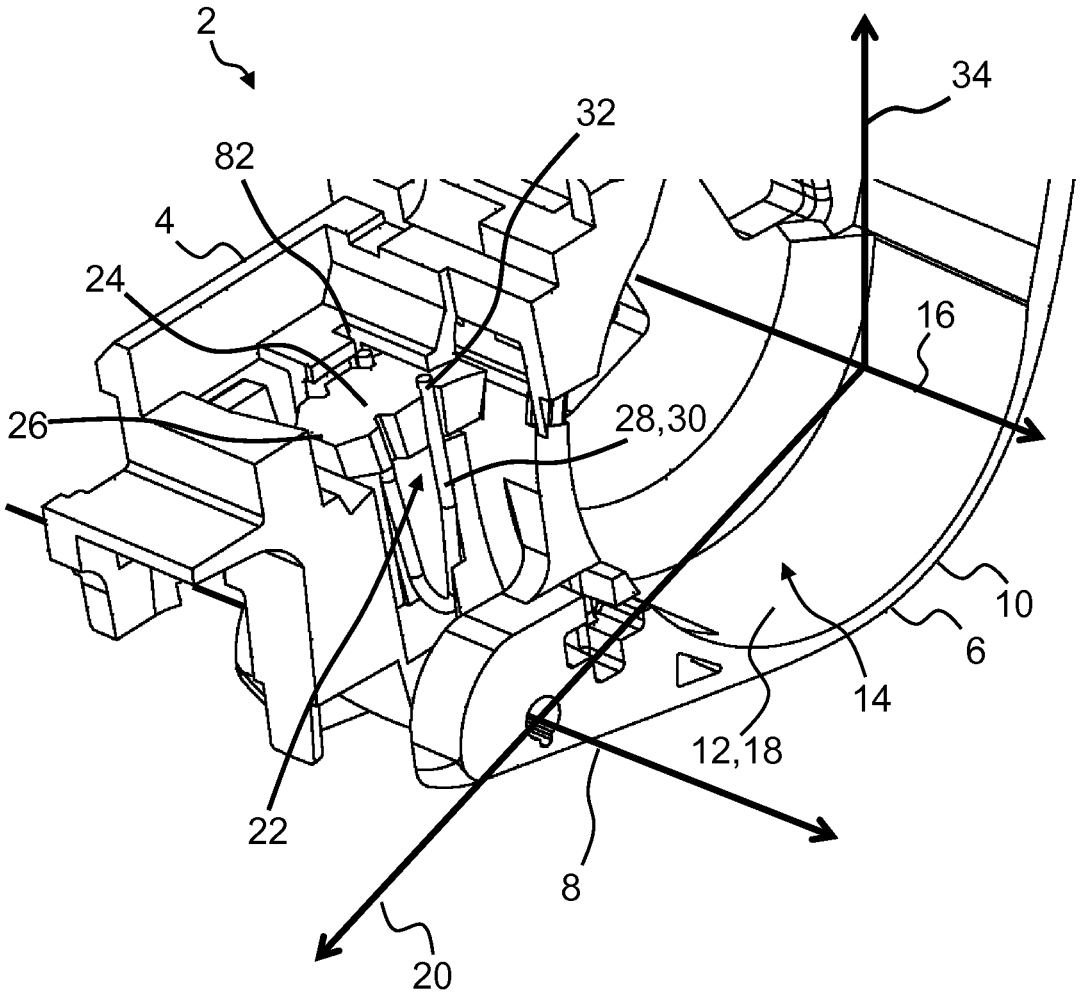

FIG. 2 schematically and partially illustrates an exemplary hearing device 2 with a battery door 6 in a closed position. Certain parts of the frame 4 are omitted for illustrative purposes. The battery door 6 is attached to the frame 4 and configured to pivot in relation to the frame 4 about the pivot axis 8.

The hearing device 2 further comprises a closure mechanism 22 comprising a protruding member 24 with a distal end 26, and an engagement member 28 having a first arm 30 with a first distal end 32. The protruding member 24 is configured to engage with the engagement member 28 when the battery door 6 is in the closed position as depicted in FIG. 2. The closure mechanism 22 is arranged in an angular space spanned by the first vector 20 and a second vector 34. The second vector is extending from the battery axis 16 in a second direction and being perpendicular to the pivot axis 8. The angle 36 (shown in FIG. 4) between the first vector 20 and the second vector 34 is less than 150°. In the example depicted, the angle 36 between the first vector 20 and the second vector 34 is 110°. However in other exemplary hearing devices and battery doors, the angle 36 between the first vector 20 and the second vector 34 may be less than 130°, such as less than 120°, such as less than 110°, such as less than 90°, such as less than 75°, such as less than 60°, such as less than 50°. A small angle enables a more compact hearing device by arranging the closure mechanism close to the pivot axis.

Also shown in FIG. 2 is that the frame 4 comprises a compartment 82 for receiving the engagement member 28. The compartment 82 connects the engagement member 28 to the frame 4. The compartment 82 restricts movement of the engagement member 28 in a tangential direction to rotation about the pivot axis 8. The compartment 82 allows movement of the engagement member 28 and/or the first distal end 32 and/or a second distal end. The compartment 82 allows movement of the engagement member 28 and/or the first distal end 32 and/or a second distal end, e.g. in a direction in a plane parallel to the pivot axis 8. The compartment 82 may allow movement of the engagement member 28 in a radial direction of a rotation about the pivot axis 8. The compartment 82 may allow movement of the engagement member 28 in a direction parallel to the pivot axis 8.

Figure 3:
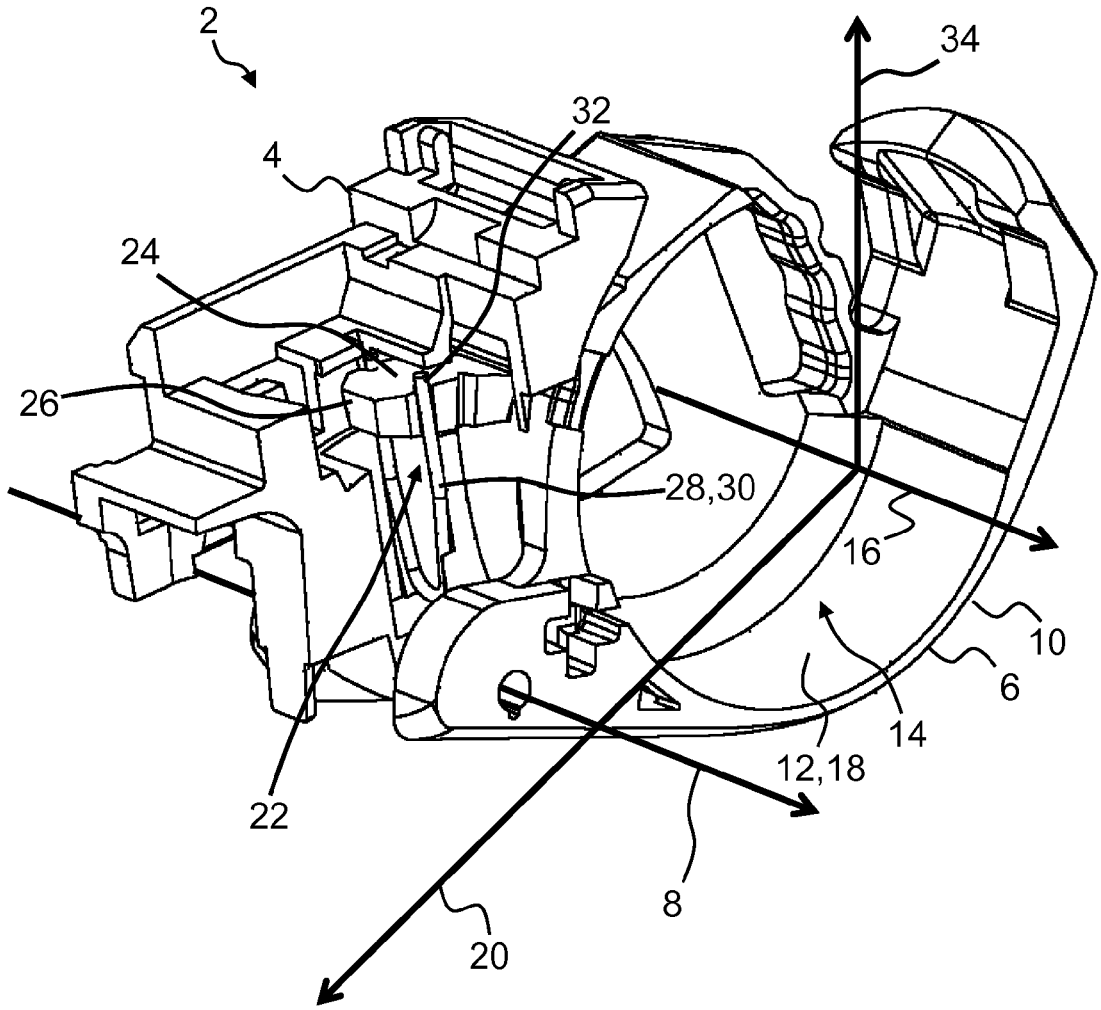

FIG. 3 schematically and partially illustrates an exemplary hearing device 2 with a battery door 6 in a semi-closed position. Certain parts of the frame 4 are omitted for illustrative purposes. The battery door 6 is attached to the frame 4 and configured to pivot in relation to the frame 4 about the pivot axis 8. The protruding member 24 is configured to engage with the engagement member 28 when the battery door 6 is in the semi-closed position as depicted. Furthermore, the protruding member 24 is configured to engage with the engagement member 28 when the battery door 6 is in the closed position as depicted in FIG. 2.

Figure 4:
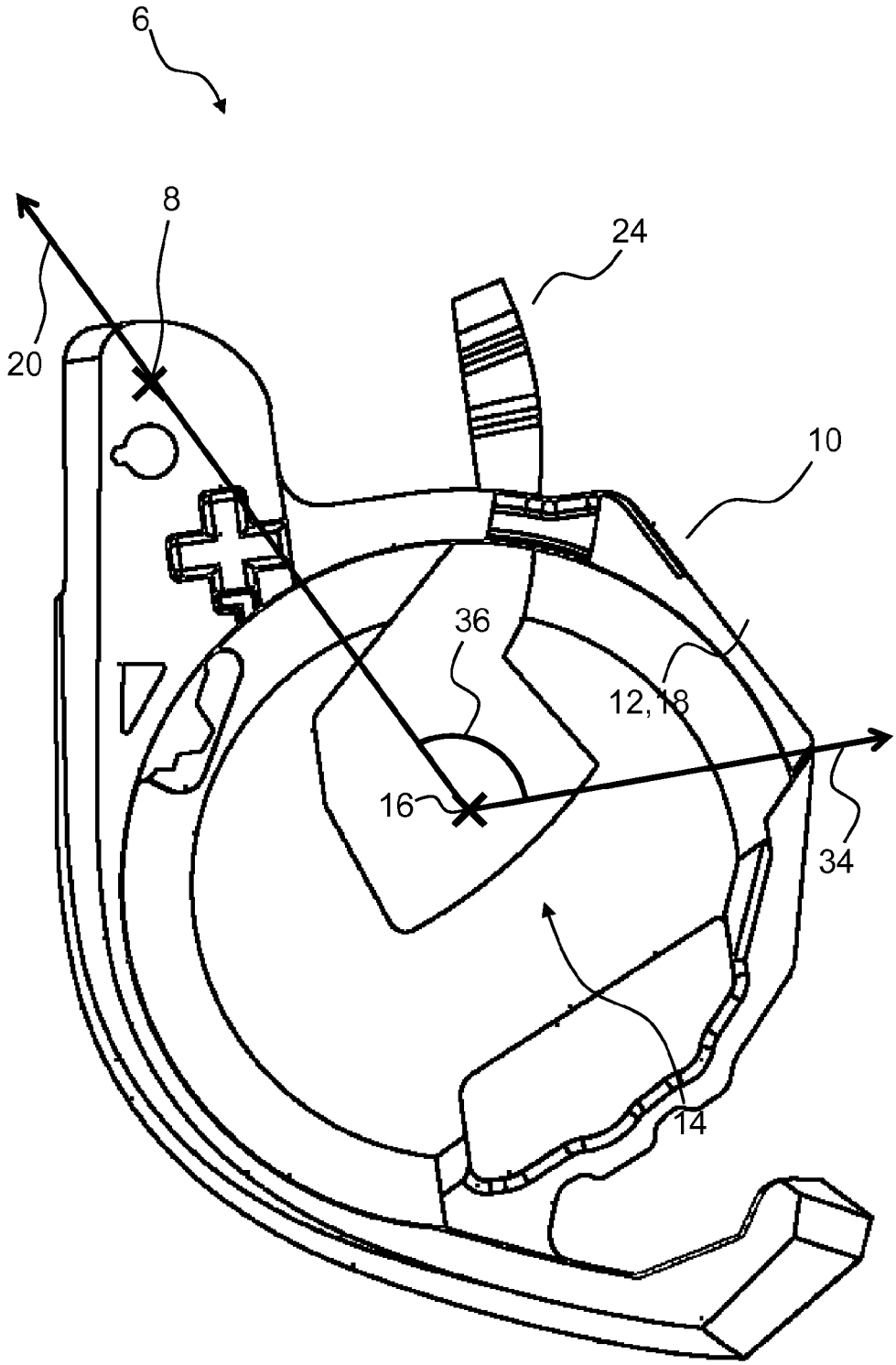

FIG. 4 schematically illustrates an exemplary battery door 6, such as the battery door 6 as described in relation to FIGS. 1-3. FIG. 4 shows the battery door 6 comprising the protruding member 24 of the closure mechanism 22. The protruding member 24 extends from the side wall 10 of the battery door 6. The side wall 10 of the battery door 6 may comprise a dock for attaching the protruding member 24 to the side wall 10. Thus, the battery door 6 and the protruding member 24 may be separate parts, e.g. attachable by mechanical engagement, e.g. press fit or click lock, and/or attachable by glue. The protruding member 24 may be an integrated part of the battery door 6.

The battery door is configured to be attached to the housing, e.g. the frame, of a hearing device, and configured to pivot in relation to the housing about the pivot axis 8.

Figure 5:
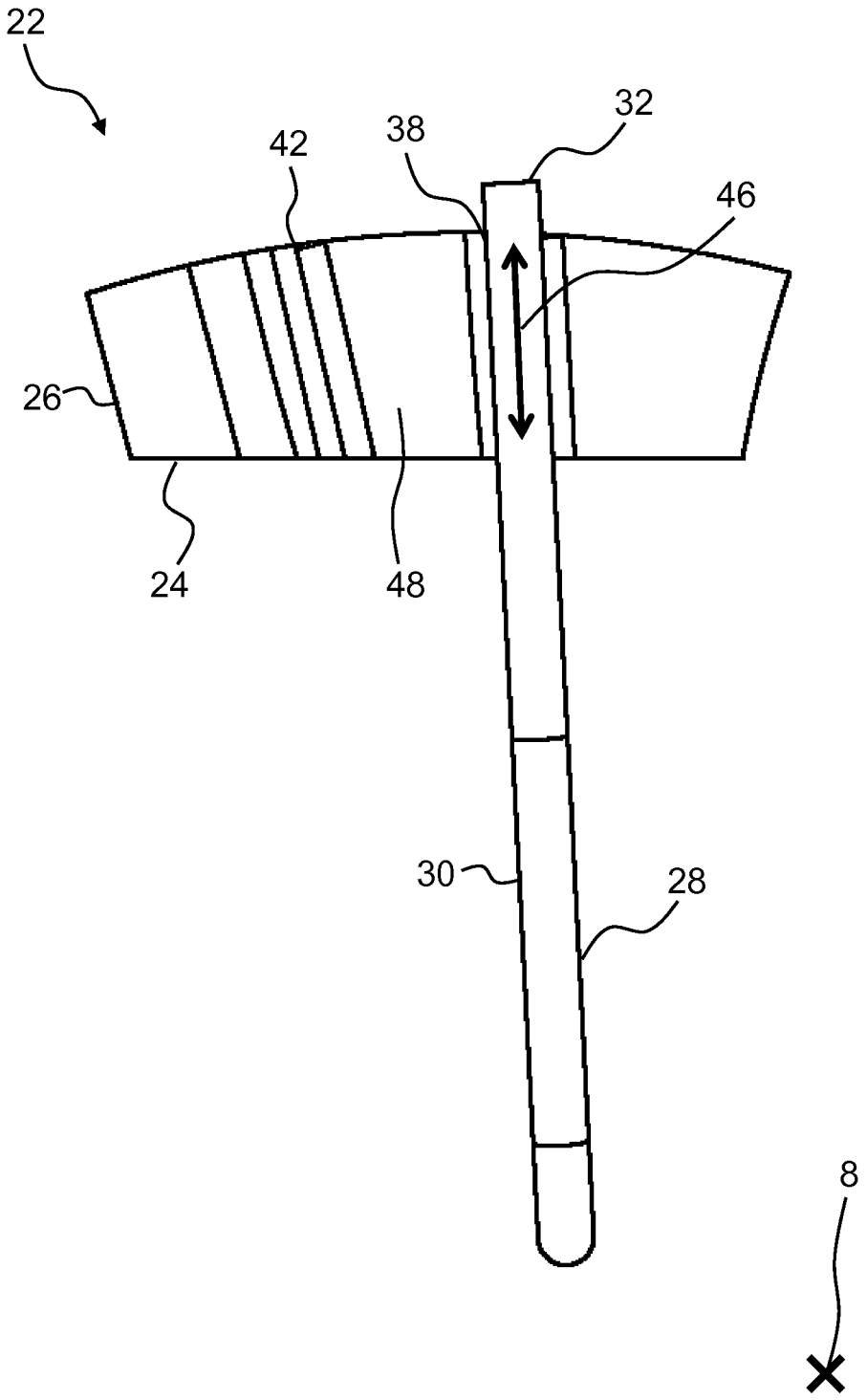
FIG. 5 is a side view of a closure mechanism in a closed position.

FIG. 5 is a side view of a closure mechanism 22 in a closed position, e.g. when the battery door 6 is in the closed position. The closure mechanism 22 comprises a protruding member 24 having a distal end 26, and an engagement member 28 having a first arm 30 with a first distal end 32.

The protruding member 24 comprises a first primary recess 38 and a first primary surface 48. The first primary recess 38 is configured to engage with the engagement member 28, such as the first arm 30, in the closed position. The first primary surface 48 is located between the distal end 26 and the first primary recess 38. When the distal end 24 of the protruding member 24 is advanced in a forward direction, e.g. when the battery door 6 moves from an open position to the closed position, the engagement member 28, such as the first arm 30, slides along the first primary surface 48 and the first primary recess 38 engage with the engagement member 28, such as the first arm 30, in the closed position. FIG. 5 depicts the first primary recess 38 being engaged with the engagement member 28. The first primary recess 38 is configured to support the engagement member 28, such as the first arm 30, along a first primary section 46 of the first primary recess 38. The first primary section 46 may be more than 50% of the length of the first primary recess 38, such as more than 70% of the length of the first primary recess 38, such as more than 90% of the length of the first primary recess 38. Increasing the first primary section 46 may provide reduced wear on the first primary recess and/or on the engagement member 28, such as the first arm 30.

The protruding member 24 further comprises a first secondary recess 42. The first secondary recess 42 is configured to engage with the engagement member 28, such as the first arm 30, in a semi-closed position, e.g. when the battery door 6 is in a semi-closed position. The first secondary recess 42 may be configured to support the engagement member 28, such as the first arm 30, along a first secondary section of the first secondary recess 42. The first secondary section may be more than 50% of the length of the first secondary recess 42, such as more than 70% of the length of the first secondary recess 42, such as more than 90% of the length of the first secondary recess 42. Increasing the first secondary section may provide reduced wear on the first secondary recess and/or on the engagement member 28, such as the first arm 30. The first secondary section and the first primary section 46 may substantially be the same length, e.g. within 5%.

Figure 6:
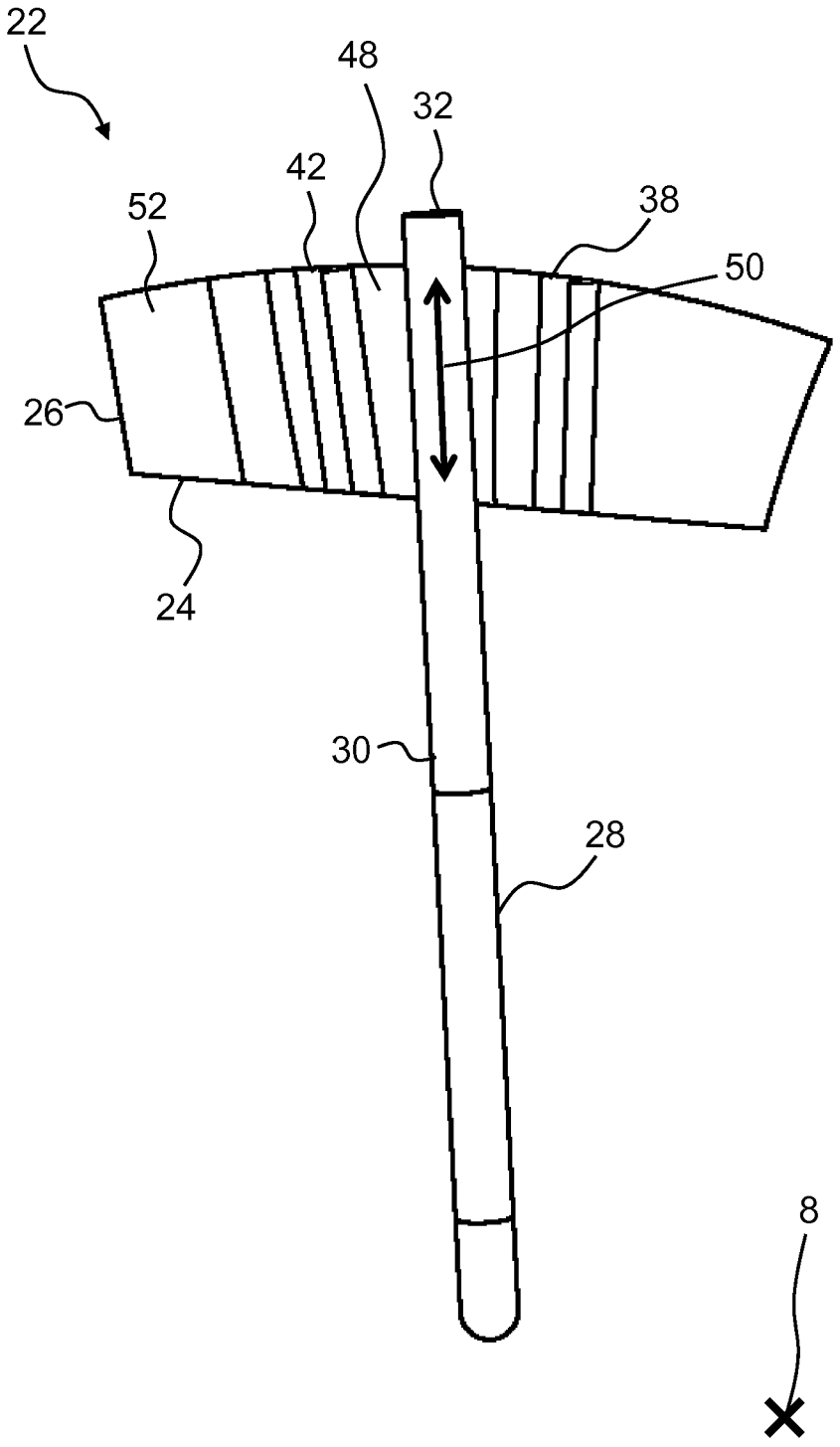
FIG. 6 is a side view of a closure mechanism in between an open and a closed position.

FIG. 6 is a side view of a closure mechanism 22 in between an open and a closed position. It is shown that in between the open and the closed position, the engagement member 28, such as the first arm 30, is engaging with the first primary surface 48. The first primary surface 48 may be configured to support the engagement member 28, such as the first arm 30, along a first support section 50 of the first primary surface 48. The first support section 50 may be more than 50% of the size of the first primary surface 48 parallel to a longitudinal direction of the first arm 30, such as more than 70% of the size of the first primary surface 48 parallel to a longitudinal direction of the first arm 30, such as more than 90% of the size of the first primary surface 48 parallel to a longitudinal direction of the first arm 30. Increasing the first support section 50 may provide reduced wear on the first primary surface 48 and/or on the engagement member 28, such as the first arm 30. The first support section 50 and the first primary section 46 may substantially be the same size.

Figure 7:
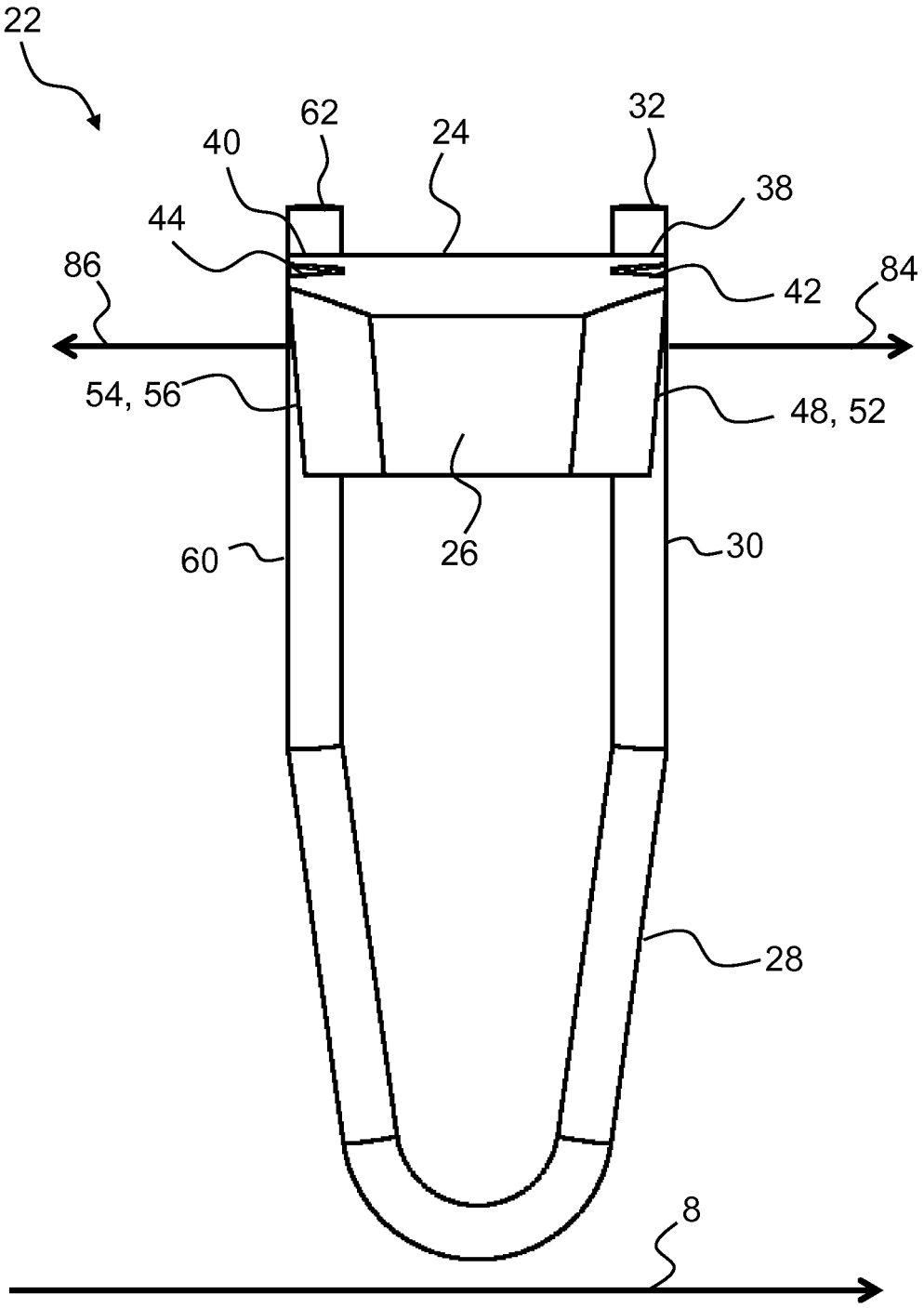
FIG. 7 is a front view of a closure mechanism in a closed position.

FIG. 7 is a front view of a closure mechanism 22 in a closed position. The closure mechanism 22 comprises a protruding member 24 with a distal end 26, and an engagement member 28. The engagement member has a first arm 30 with a first distal end 32, and a second arm 60 with a second distal end 62. The protruding member 24 comprises a first primary recess 38, a first primary surface 48, a first secondary recess 42 and a first secondary surface 52. Furthermore, the protruding member 24, as depicted, comprises a second primary recess 40, a second primary surface 54, a second secondary recess 44 and a second secondary surface 56.

When the closure mechanism 22 is in a closed position, the first primary recess 38 is configured to engage with the first arm 30 of the engagement member 28, and the second primary recess 40 is configured to engage with the second arm 60 of the engagement member 28.

When the closure mechanism 22 is in a semi-closed position, the first secondary recess 42 is configured to engage with the first arm 30 of the engagement member 28, and the second secondary recess 44 is configured to engage with the second arm 60 of the engagement member 28.

When the closure mechanism 22 is in between the closed position and the semi-closed position, the first primary surface 48 is configured to engage with the first arm 30 of the engagement member 28, and the second primary surface 54 is configured to engage with the second arm 60 of the engagement member 28.

When the closure mechanism 22 is in between an open position and the semi-closed position, the first secondary surface 52 is configured to engage with the first arm 30 of the engagement member 28, and the second secondary surface 56 is configured to engage with the second arm 60 of the engagement member 28.

The first secondary recess 42, the second secondary recess 44, the first secondary surface 52, and the second secondary surface 56 may be omitted. Thus the first primary surface 48 is configured to engage with the first arm 30 of the engagement member 28, and the second primary surface 54 is configured to engage with the second arm 60 of the engagement member 28 when the closure mechanism is between the open position and the closed position.

The engagement member 22, such as the first arm 30 and/or the second arm 60, is flexible, such that when advancing the protruding member 24 from the closed position to a position between the closed position and the open position or the semi-closed position, the first distal end of the first arm 30 is displaced in a first displacement direction 84 and the first distal end of the second arm 60 is displaced in a second displacement direction 86. Thereby, the first primary surface 48 is engaging with the first arm 30 and the second primary surface 54 is engaging with the second arm 60, allowing the advancement of the protruding member 24. The first displacement direction 84 has a first primary directional component in a plane parallel to the pivot axis 8. The second displacement direction 86 has a second primary directional component in a plane parallel to the pivot axis 8. The first displacement direction 84, or the first primary directional component of the first displacement direction 84, and the second displacement direction 86, or the second primary directional component of the second displacement direction 86, may be substantially opposite.

As depicted, the first primary directional component and the second primary directional component may be parallel to the pivot axis 8. However, in another exemplary closure mechanism (not shown) the closure mechanism may be rotated in the plane parallel to the pivot axis. For example, the first primary directional component and the second primary directional component may be perpendicular to the pivot axis 8.

The compartment 82, as described in relation to FIG. 2, may allow movement of the engagement member 28, or the first arm 30 and/or the second arm 60, in the first displacement direction 84 and/or the second displacement direction 86.

Figure 8:
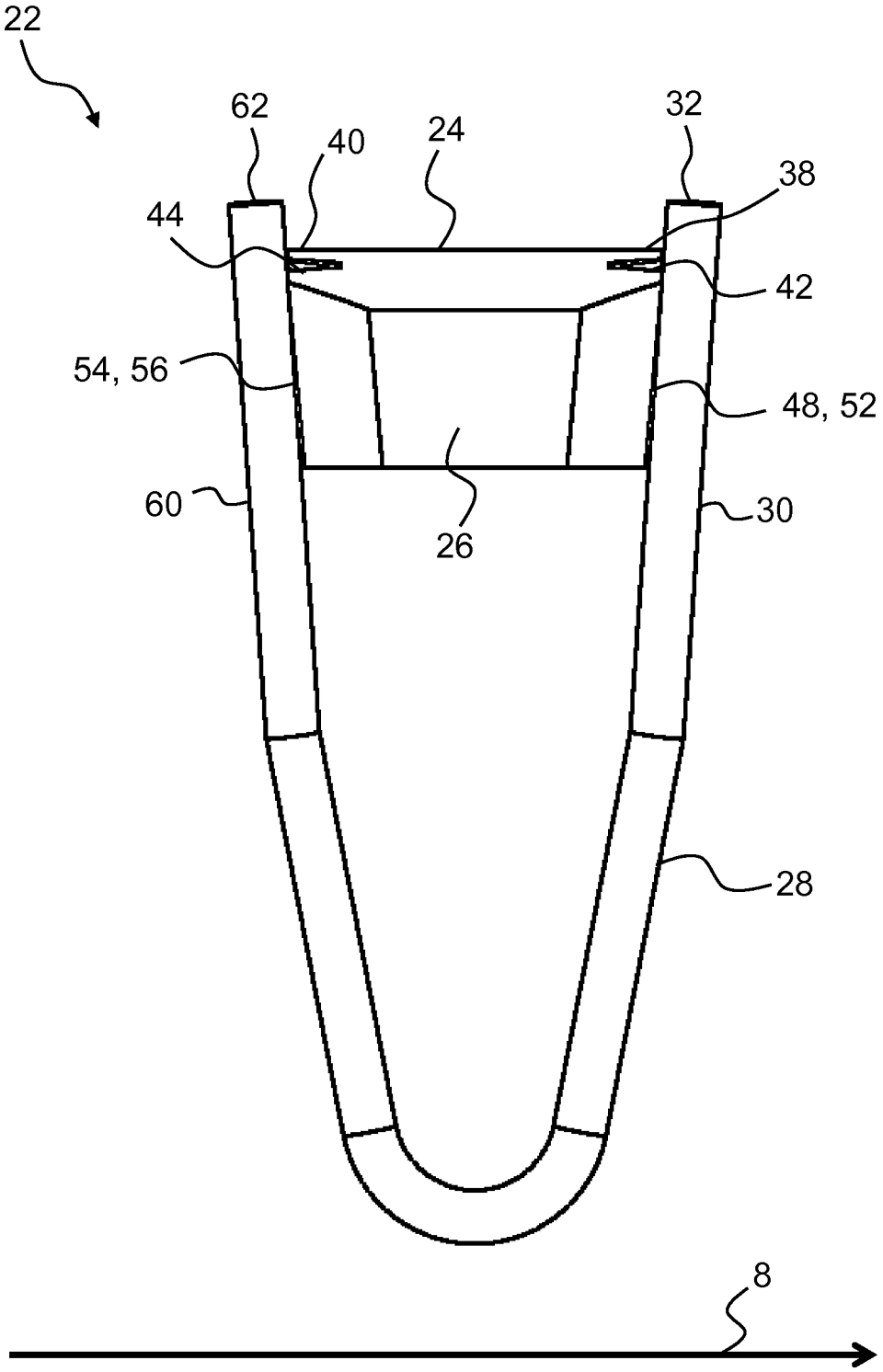
FIG. 8 is a front view of a closure mechanism in between an open and a closed position.

FIG. 8 is a front view of a closure mechanism 22 in between an open position and a closed position. The first primary surface 48 is engaging with the first arm 30 of the engagement member 28, and the second primary surface 54 is engaging with the second arm 60 of the engagement member 28. As may be realized from FIG. 8 and FIG. 7, displacement of the first distal end 32 of the first arm 30 and displacement of the second distal end 62 of the second arm 60, caused by advancement of the protruding member from the closed position to a position between the closed position and the open position, has changed the angle of the first arm 30 and the second arm 60. Thus in order to reduce wear on the engagement member and/or the protruding member, it is desirable that the first arm 30 is supported on the first primary surface 48 along a first support section, such as the first support section 50 as described in relation to FIG. 6, when the closure mechanism 22 is in between an open position and the closed position, and that the first arm 30 is supported in the first primary recess 38 along a first primary section, such as the first primary section 46 as described in relation to FIG. 5, when the closure mechanism 22 is in the closed position. Similarly, it is desirable that the second arm 60 is supported on the second primary surface 54 along a second support section when the closure mechanism 22 is in between an open position and the closed position, and that the second arm 60 is supported in the second primary recess 40 along a second primary section when the closure mechanism 22 is in the closed position. To achieve the desirable effect that the first arm 30 and/or the second arm 60 is supported along a length both when engaged in a recess, such as the first primary recess 38 and/or the second primary recess 40 and/or the first secondary recess 42 and/or the second secondary recess 44, and when engaged on a surface, such as the first primary surface 48 and/or the second primary surface 54 and/or the first secondary surface 52 and/or the second secondary surface 56, the gradient of the recess and the gradient of the surface are different. This is further described in relation to FIG. 9.

Figure 9:
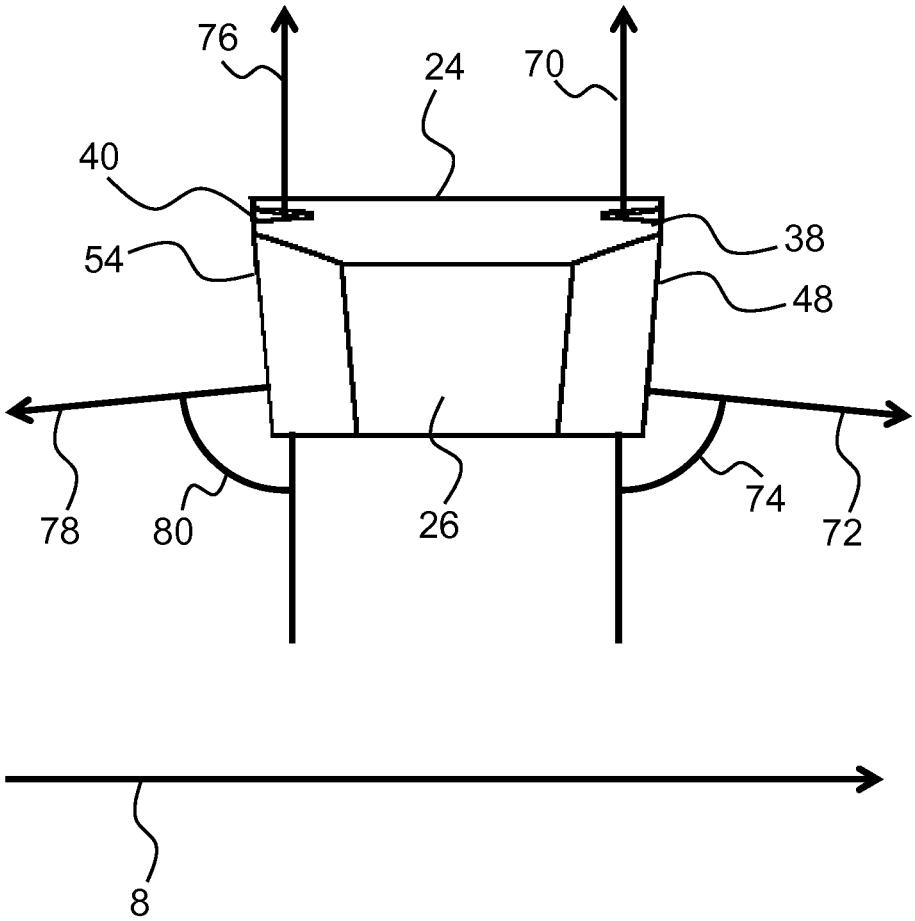
FIG. 9 is a front view of a protruding member.

FIG. 9 is a front view of a protruding member 24. FIG. 9 furthermore shows a first primary principal direction 70 along the first primary recess 38, a first primary normal 72 to the first primary surface 48, a second primary principal direction 76 along the second primary recess 40, and a second primary normal 78 to the second primary surface 54. The first normal angle 74 between the first primary principal direction 70 and the first primary normal 72 is shown to be non-perpendicular, thereby providing support of the first arm 30 when engaged in the first primary recess 38 and when engaged on the first primary surface 48. Similarly, the second normal angle 80 between the second primary principal direction 76 and the second primary normal 78 is shown to be non-perpendicular, thereby providing support of the second arm 60 when engaged in the second primary recess 40 and when engaged on the second primary surface 54. Magnitude of the normal angles 74, 80 is determined by the geometry of the engagement member 22 and displacements of the first arm 30 and the second arm 60 when the engagement member 22 is advanced from the closed position to a position between the closed position and the open position. The magnitude of the normal angles 74, 80 may be less than 90°, such as less than 85° and/or in the range from 45° to 89°, such as in the range from 60° to 88°, such as in the range from 75° to 88°.

Although particular embodiments have been shown and described, it will be understood that they are not intended to limit the claimed inventions, and it will be obvious to those skilled in the art that various changes and modifications may be made without departing from the scope of the claimed inventions. The specification and drawings are, accordingly, to be regarded in an illustrative rather than restrictive sense. The claimed inventions are intended to cover alternatives, modifications, and equivalents.

LIST OF REFERENCES

2 hearing device
3 housing
4 frame
6 battery door
8 pivot axis
10 side wall
12 first wall surface
14 battery compartment
16 battery axis
18 contact points
20 first vector
22 closure mechanism
24 protruding member
26 distal end of protruding member
28 engagement member
30 first arm
32 first distal end
34 second vector
36 angle between first vector and second vector
38 first primary recess
40 second primary recess
42 first secondary recess
44 second secondary recess
46 first primary section
48 first primary surface
50 first support section
52 first secondary surface
54 second primary surface
56 second secondary surface
60 second arm
62 second distal end
64 support section of second arm
70 first primary principal direction
72 first primary normal
74 first normal angle
76 second secondary principal direction
78 second primary normal
80 second normal angle
82 compartment
84 first displacement direction
86 second displacement direction

The invention claimed is:

1. A hearing device comprising:

a housing with a frame;

a battery door attached to the housing and configured to pivot in relation to the housing about a pivot axis, the battery door having a side wall with a first wall surface at least partly forming a battery compartment with a battery axis, the first wall surface comprising contact points for supporting a battery, the contact points having equal distances to the battery axis, wherein a first vector extends from the battery axis and perpendicularly crosses the pivot axis in a first direction from the battery axis to the pivot axis; and a closure mechanism comprising a protruding member with a distal end, and an engagement member having a first arm with a first distal end, wherein the protruding member is configured to engage with the engagement member when the battery door is in a closed position, the first distal end of the first arm being moveable relative to the housing.

2. The hearing device according to claim 1, wherein the closure mechanism is arranged in a space formed between the first vector and a second vector extending from the battery axis in a second direction and being perpendicular to the pivot axis, wherein an angle between the first vector and the second vector is less than 150°.

3. The hearing device according to claim 1, wherein the protruding member extends from the side wall.

4. The hearing device according to claim 1, wherein the protruding member comprises a primary recess, and wherein the primary recess is configured to engage with the engagement member when the battery door is in the closed position.

5. The hearing device according to claim 4, wherein the protruding member comprises a secondary recess, wherein the secondary recess is configured to engage with the engagement member when the battery door is in a semi-closed position.

6. The hearing device according to claim 4, wherein the primary recess is configured to support the first arm along a primary section of the primary recess when the battery door is in the closed position.

7. The hearing device according to claim 4, wherein the protruding member comprises a primary surface between the distal end of the protruding member and the primary recess, the primary surface having a primary normal, and wherein an angle between the primary normal and a principal direction along the primary recess is anywhere from 75° to 88°.

8. The hearing device according to claim 1, wherein the sidewall of the battery door comprises a dock for attaching the protruding member or the engagement member to the battery door.

9. A hearing device comprising:

a housing with a frame;

a battery door attached to the housing and configured to pivot in relation to the housing about a pivot axis, the battery door having a side wall with a first wall surface at least partly forming a battery compartment with a battery axis, the first wall surface comprising contact points for supporting a battery, the contact points having equal distances to the battery axis, wherein a first vector extends from the battery axis and perpendicularly crosses the pivot axis in a first direction from the battery axis to the pivot axis; and a closure mechanism comprising a protruding member with a distal end, and an engagement member having a first arm with a first distal end, wherein the protruding member is configured to engage with the engagement member when the battery door is in a closed position;

wherein the first distal end of the first arm is displaceable in a displacement direction when the battery door is moved from an open position to the closed position, wherein the displacement direction has a primary directional component parallel to the pivot axis.

10. The hearing device according to claim 9, wherein the displacement direction has a secondary directional component perpendicular to the primary directional component, the secondary directional component being smaller than the primary directional component.

11. The hearing device according to claim 1, wherein the engagement member has a second arm with a second distal end.

12. The hearing device according to claim 1, wherein the engagement member is made of metal.

13. The hearing device according to claim 1, wherein the frame comprises a compartment for receiving the engagement member and connecting the engagement member to the frame.

14. A hearing device comprising:

a housing with a frame;

a battery door attached to the housing and configured to pivot in relation to the housing about a pivot axis, the battery door having a side wall with a first wall surface at least partly forming a battery compartment with a battery axis, the first wall surface comprising contact points for supporting a battery, the contact points having equal distances to the battery axis, wherein a first vector extends from the battery axis and perpendicularly crosses the pivot axis in a first direction from the battery axis to the pivot axis; and a closure mechanism comprising a protruding member with a distal end, and an engagement member having a first arm with a first distal end, wherein the protruding member is configured to engage with the engagement member when the battery door is in a closed position;

wherein the frame comprises a compartment for receiving the engagement member and connecting the engagement member to the frame;

wherein the engagement member is movable within the compartment in at least one direction in a plane parallel to the pivot axis.

15. The hearing device according to claim 14, wherein the first distal end of the first arm is displaceable in a first displacement direction when the battery door is moved from an open position to the closed position, wherein the first displacement direction has a first primary directional component parallel to the pivot axis;

wherein the engagement member further comprises a second arm with a second distal end that is displaceable in a second displacement direction when the battery door is moved from the closed position to a semi-closed position, the second displacement direction having a second primary directional component; and wherein the at least one direction includes the first primary directional component and the second primary directional component.

16. The hearing device according to claim 1, wherein the protruding member extends from the battery door, and is configured to apply a force against the first arm to displace the first arm.

* * * * *